United States Patent [19]

Bradley

[11] 4,258,449

[45] Mar. 31, 1981

[54] STIFFENER FOR SHOES OR THE LIKE

[75] Inventor: Robert W. Bradley, Marblehead, Mass.

[73] Assignee: Bush Universal, Inc., Woburn, Mass.

[21] Appl. No.: 945,243

[22] Filed: Sep. 25, 1978

Related U.S. Application Data

[62] Division of Ser. No. 765,096, Feb. 3, 1976, Pat. No. 4,133,117.

[51] Int. Cl.[3] ..... A43D 31/00

[52] U.S. Cl. ..... 12/146 S; 12/40.5

[58] Field of Search ..... 12/146 R, 146 S, 146 D, 12/40.5; 36/76 R, 76 C, 76 H, 77, 98

[56] References Cited

U.S. PATENT DOCUMENTS

| | | | |
|---|---|---|---|
| 2,269,562 | 1/1942 | Stritter | 36/76 C |
| 2,294,982 | 9/1942 | Hathaway | 36/76 R |
| 2,832,976 | 5/1958 | Huprich | 36/76 R |
| 4,081,917 | 4/1978 | Bradley et al. | 36/76 R |
| 4,133,117 | 1/1979 | Bradley | 12/146 S |

*Primary Examiner*—Patrick D. Lawson

*Attorney, Agent, or Firm*—Wolf, Greenfield & Sacks

[57] ABSTRACT

A strip which will form a rigid shoe stiffener, such as a shoe shank, is applied to the surface of a shoe to be stiffened, such as to the bottom of an insole. The shank strip is flexible and includes a carrier sleeve or envelope containing a plurality of fiberglass strands in thermosetting plastic matrix. After the shank strip is in place on the insole, the matrix is activated by exposing it to an external stimulus such as radiant heat which is applied locally to the shank strip. Curing takes place in situ on the insole bottom. The carrier sleeve is formed in a manner which provides control over the shape of the cured stiffener as well as a means to facilitate handling of the shank strip.

6 Claims, 6 Drawing Figures

Fig. 1
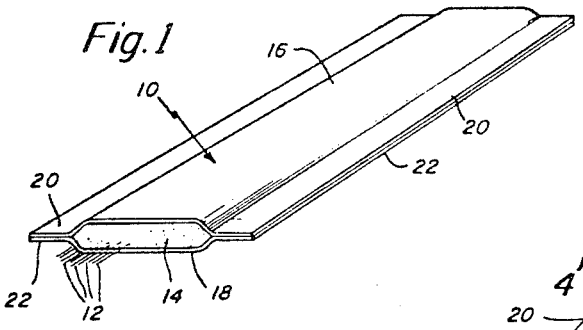
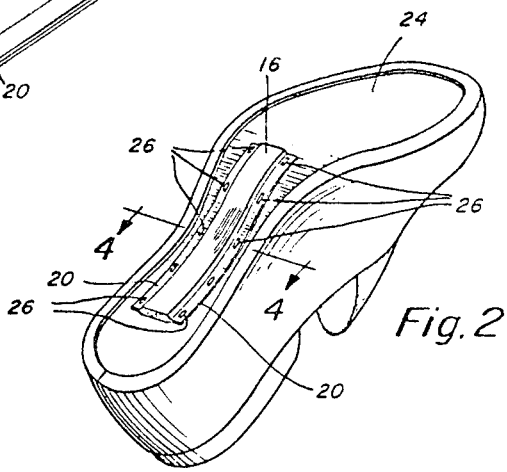
Fig. 2
Fig. 3
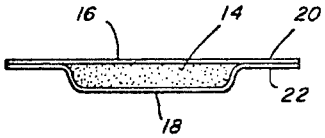
Fig. 4
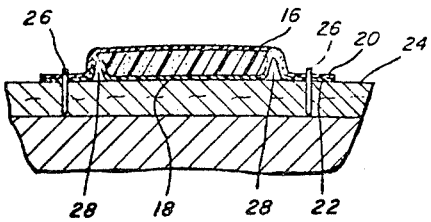
Fig. 5
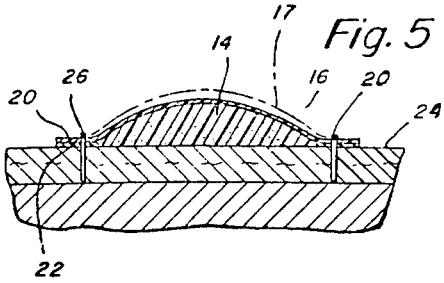
Fig. 6
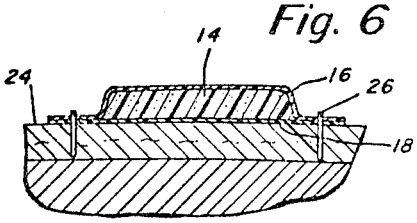

STIFFENER FOR SHOES OR THE LIKE

This is a division of application Ser. No. 765,096, filed Feb. 3, 1976, now U.S. Pat. No. 4,133,117.

BACKGROUND AND SUMMARY OF THE INVENTION

This invention relates to shoe manufacturing and, particularly, to improvements in reinforcing and stiffening portions of a shoe such as a shank region of the insole which extends from the heel to the ball portion. The invention relates to improvements in articles for forming a shank stiffener of the type disclosed in U.S. Pat. Application Ser. No. 681,562, filed jointly by me with D. Bray and R. Peterson on Apr. 29, 1976 and which is assigned to the asignee of this application. That application discloses techniques and articles for forming shoe shanks, the articles being in the form of an elongate shank strip or rope having a carrier sleeve which contains a plurality of fiberglass strands in a thermosetting plastic resin matrix. The thermosetting matrix is activatable in response to a selected external stimulus such as, for example, radiant heat. The sleeve preferably is formed from a material which is transparent to radiant energy to permit activation of the resin in situ on the insole bottom. The shank thus formed adheres to the insole bottom by any of a variety of means including but not limited to, melting of the sleeve to form an adhesive bond, direct contact between the resin matrix and the insole, application of an adhesive layer between the shank strip and the insole or a combination of these. Although the articles and techniques disclosed in said application have proved to be effective in accomplishing their objectives, there may be some instances in which the resin tends to expand as it cures, which may result in less than desired uniformity in the shape of the shanks. While in most instances, the expansion of the resin may be controlled or avoided by carefully controlling the conditions under which the shank strip is heated and cured, the use of fine or sensitive control procedures preferably is to be avoided under production conditions. The present invention employs an improved sleeve structure and method for automatically controlling the shape of the stiffener. The present invention reduces considerably the need for external controls and, in addition, provides an improved means by which the shank strip may be handled.

In brief, the present invention resides in the use of a carrier sleeve having upper and lower surfaces formed from separate sheets or strips which may be of different materials. The strips are attached to each other along their longitudinal edges which define relatively wide margins. The fiberglass strands and thermosetting matrix extend longitudinally within the middle of the sleeve, between the margins. The upper strip or surface of the sleeve preferably is substantially transparent to the radiant energy to permit the resin to be activated. The upper strip preferably is formed from a material which will not melt, deteriorate or otherwise lose its strength (for example, its tensile properties) from exposure to the radiant heat or from exothermal heat generated during the curing process, or at least until the resin has assumed a substantially final shape. The lower, insole-engaging surface of the sleeve preferably is thermoplastic and preferably will melt under the influence of the applied and/or exothermally generated heat to serve as an adhesive bond between the cured shank strip and the insole bottom. The wide margins of the carrier sleeve provide a means by which the shank strip may be held against the insole bottom to retain the carrier sleeve in place during the activation and curing process. During activation and curing, the tendency for the matrix to expand (for example, because of formation of gas bubbles) is resisted by the upper surface of the carrier sleeve which serves to confine the resin (and the bottom thermoplastic strip) between it and the insole bottom. This is effective to preclude the strip from assuming a freely expanded shape which, in some types of shoes, is undesirable. In a variant of the invention, the upper strip of the carrier sleeve is formed from a shrinkable film which will shrink during activation and curing of the resin. As the upper strip shrinks, it causes the resin matrix to be pressed into a cross sectional shape having a reduced height and smoothly tapered edges.

It is among the general objects of the invention to provide an improved sleeve construction for use in elongate stiffening devices of the type described.

Another object of the invention is to provide an improved article for use in connection with stiffening of shoe insoles or the like in which the article includes self-contained means by which the shape of the cured stiffener may be self-controlled.

A further object of the invention is to provide an improved elongate shank stiffener of the type described having a curable resin surrounded by a carrier sleeve and in which the carrier sleeve has upper and lower surfaces formed from different materials.

Another object of the invention is to provide a shank strip having a carrier sleeve of the type described in which the upper surface of the carrier sleeve has a high melting temperature and will not lose its tensile strength as a result of heat applied to or generated by the thermosetting matrix during curing at least until the resin has cured to a substantially final shape.

A further object of the invention is to provide a shank strip of the type described in which the carrier sleeve has wide margins to facilitate handling of the shank strip.

DESCRIPTION OF THE DRAWINGS

The foregoing and other objects and advantages of the invention will be understood more fully from the following further description thereof, with reference to the accompanying drawings wherein:

FIG. 1 is an illustration of a portion of a rope from which a shank strip segment might be cut;

FIG. 2 is an illustration of a shoe bottom with the shank strip located on the shoe bottom;

FIG. 3 is an illustration of a modified cross-sectional form of a shank strip;

FIG. 4 is a sectional illustration of the shank strip shown in FIG. 3 in place on the insole bottom as might be seen along the line 4—4 of FIG. 2;

FIG. 5 is a somewhat diagrammatic illustration similar to FIG. 4 showing the shank strip after it has been activated and has cured and illustrating the effect achieved by employing a heat shrinkable film for the top strip of the carrier sleeve; and FIG. 6 is an illustration, similar to FIG. 4, showing the shank strip having a still further modified cross-sectional shape, attached to the insole bottom in readiness to be activated.

DESCRIPTION OF THE PREFERRED EMBODIMENT

FIG. 1 shows a segment of the rope from which lengths may be severed. The rope includes an envelope in the form of an elongate outer carrier sheath or sleeve indicated generally at 10 which contains a multiplicity of elongate fiber strands 12 embedded in a fluid matrix 4 composed of a thermosetting resin and catalyst which will not polymerize or cross link under ambient conditions over long shelf lives of, for example, three months or more. The rope is flexible and long lengths of it, for example, hundreds of feet, may be wound on a reel to facilitate manufacture of the rope, storage, handling, and subsequent use. The ends of the reel-up rope are preferably sealed. Various resins and catalyst formulations and fiber reinforcements which may be used in the matrix are described in depth in the specification of the aforementioned pending patent application which is incorporated by reference herein.

In accordance with the present invention, the carrier sleeve 10 is formed from a pair of sheets of strips of material, including what is defined as an upper or first strip 16 and a lower or second strip 18, the lower strip being intended to be applied directly to the element to be stiffened, such as an insole bottom. The upper and lower strips 16, 18 may be formed to define their carrier sleeve configuration, encasing the matrix and fiberglass strands, by commercially available sealing equipment which can join the longitudinally extending margins 20, 22 of the strips 16, 18. The margins 20, 22 may be joined by any of a variety of well known techniques such as interposing an appropriate adhesive between the marginal edges and/or heat sealing. Preferably, the margins are relatively wide and by way of example, in a strip which is 1½" wide overall, the width of the matrix would be approximately ¾ and each of the margins would be approximately ¾". In a preferred configuration of the invention, for use as a shank stiffener, the shank strip may be generally flat, having a height of approximately 0.080". In most cases, the rope has a width of from ½ to 2 inches, with each margin having a width of from ⅛ to ½ inch, the matrix having a width of ¼ to 1 inch and a thickness of from 0.05 to 0.250 inch. Lengths of from a few inches or longer can be hardened into completed shank strips.

The lower, insole-engaging strip 18 may be formed from a relatively low melt temperature thermoplastic such as polyethylene having a melting point such that it will melt and fuse with the thermosetting resin upon cross linking and polymerization. For example, the polyethylene may melt between 175° F. to 275° F. Other materials may be employed for the lower strip 18 such as cellulose acetate, cellulose buyrate, polyvinyl acetate or the like. In some instances, the lower strip 18 could even be a thermosetting material such as a rubber material or a crosslinked polyester-styrene combination compatible and bondable with the matrix material of the finished shank stiffener. In all cases, it is preferable that the lower, as well as the upper strip, be impermeable to migration outwardly of the matrix and prevent inward migration or passage of materials which might adversely affect the shelf life of the stored matrix material. When the lower strip does not melt or disperse during the hardening of the matrix, it can be provided with perforations during or slightly before hardening to provide for adhesion of the matrix to the shoe bottom. In some cases, a supplementary adhesive can be used to bond to the shoe bottom.

The upper strip 16 is formed from a thin sheet of material which is transparent to the radiant energy or other external stimulus to be used to activate the matrix. In accordance with an important feature of the preferred embodiment of the present invention, the material from which the upper strip 16 is formed will retain at least some of its tensile properties and will not melt or otherwise adversely deteriorate during activation of the matrix, at least until the matrix has cured sufficiently to its final shape. Thus, where the matrix is activatable by heat (as from an infrared heater) and where the matrix generates an exothermal reaction, the upper strip 16 should be temperature resistant at least to the extent that it will not deteriorate from the effect of such exothermal temperatures, at least until the reaction has been substantially completed to an extent in which the shape and size of the resin has become fixed. By way of example, where temperatures of the order of 400°–420° F. may be reached from the combined effect of the exothermal reaction and the infrared heater, the material of the upper strip should be selected to be capable of maintaining its strength and integrity up to that level. It may be noted that usually the thermoset matrix will cure to its final shape before the maximum temperature has been reached, and in that case, the upper strip may be permitted to melt or otherwise deteriorate at that temperature level. By way of example, the upper strip 16 may be made from a number of polyester films, such as Mylar, a trademark product of polyethylene terephthalate sold by E. I. DuPont de Nemours & Co., Wilmington, Del. (melt temperature of about 420° F.) and may be of the order of 0.001" thick.

Top strip materials are preferably shrink materials such as axially or biaxially oriented polyethylene terephthalate (Mylar). Such materials are preferably selected so that they shrink 5 to 35% in width in 3 to 5 seconds at temperatures of 300° F. or the temperature of the shank strips during hardening. Such films have good tensile strength as for example resistance to 25000 psi at 70° C. to 300° C. Surprisingly, very little force or resistance to matrix expansion need be provided by the top strip to prevent unwanted expansion of the matrix. Other materials which can be used for the top strip include, but are not limited to, other polyesters such as polybutylene terephthalate, polyethylene nylon, polypropylene, polybuylene and copolymers of the above and other plastics.

The thickness ranges of the top and bottom skins can vary depending on the particular shanks to be formed and particular materials used. Preferably, in order to minimize expense and maximize desirable handling and storage properties the top and bottom skins or strips each may have a thickness in the range of from 0.0005 inches and preferably in the range of 0.0005 to 0.0025 inch.

The margins of the skins may be bonded to each other in a heat sealing process. When the top skin is Mylar and the bottom skin polyethylene, it is preferred to coat the surface of the polyethylene with a thin film of ethyl vinyl acetate (EVA) to promote the heat sealing process without causing deterioration of the polyethylene. Alternatively, polyethylene mixed with 3%-8% EVA may be employed. Such a polyethylene-EVA composition is available from St. Regis Paper Co.

The shoe bottom material to which the shank strips are adhered can be of any conventional shoe insole material as, for example, fibrous board, leather or the like.

As shown in FIG. 2, a shank strip of desired length, typically four to six inches in length is cut from the rope-like supply and is placed on the bottom of the insole, with the lower strip 18 in engagement with the insole 24. The wide margins of the carrier sleeve 10 provide a convenient, mess-free means by which the carrier sleeve can be held in place, for example, by staples 26. The shank strip then is exposed to the external stimulus, as described in said prior application, to activate the thermosetting matrix. As described in the foregoing example, the applied heat and the exothermal reaction of the matrix during curing generate progressively increasing temperatures up to approximately 400° F. to 420° F., sufficiently high to melt the lower strip 16 of the carrier sleeve 10 and cause cross linking and merging of the lower strip 16 and matrix into a single mass which adheres to the insole bottom. The matrix usually will assume its final shape before the maximum temperature has been reached. The upper strip 16 or film, which will retain its mechanical properties (such as tensile strength) and has a melt temperature at or slightly higher than that generated during curing, retains its size and form to confine the thermosetting material between it and the insole bottom as the reaction proceeds. Thus, if the matrix tends to expand during curing, it will be confined by the upper strip 16 to limit the height as well as general cross-sectional shape of the stiffener which will result. In this regard, it should be noted that the forces of expansion which may tend to be developed by the matrix are relatively light and can be sufficiently resisted by the upper strip 16 to assure that the resin will not expand beyond a desired height and configuration. Although in some instances, it has been found that the upper strip 16 may deteriorate somewhat and merge with the matrix material in the regions in which it is in contact with the matrix, the strip 16 does resist deterioration sufficiently to confine any unwanted expansion of the matrix during the hardening or curing step. This occurs even though in some cases the top strip is formed of a material with a low softening point and which may become discontinuous after the curing step. The marginal portions of the strip 16 may only curl or buckle. The marginal strips are easily detachable from the shoe bottom and may be stripped off if desired. It might be noted that in some instances, such as with welt shoes, there may be no particular advantage obtained by stripping the remaining margins of the carrier sleeve 10 because that region subsequently will be filled with a filler material as is well known to those skilled in the art and under such circumstances the margins may remain.

The embodiment of the shank strip illustrated in FIG. 1 has a cross section in which the margins of each of the upper and lower strips 16, 18 are formed at a level which is approximately intermediate the thickness of the central portion of the strip. It may be noted that in the shank strip described above, having a polyester (Mylar) top strip 16 and a polyethylene lower strip may be more like that suggested in FIG. 3, in which the upper strip 16 is generally flat and the lower strip 18 is somewhat channel-shaped to receive and accommodate the matrix. This configuration may result, depending on the type of rope manufacturing equipment employed. It should be noted that the polyethylene typically will be more easily stretched during the manufacturing procedure than the polyester top strip, which accounts for the cross sectional shape shown in FIG. 3. FIG. 4 illustrates the manner in which the strip shown in FIG. 3 is applied to the bottom of the insole. Although there may be some voids, as suggested (in exaggeration) at 28, when the shank strip is activated and the lower polyethylene strip 18 merges and fuses with the resin, the expansion which usually takes place will cause the matrix to substantially fill any voids. FIG. 5 illustrates, somewhat diagrammatically, the cross-sectional configuration of the stiffener after the lower strip has been merged and fused into the matrix, with the stiffener in its final shape but before the upper strip 16 has deteriorated.

It should be noted that the somewhat diagrammatic illustrations of FIGS. 4 and 5 relate to an upper strip 16 which will shrink in response to the heat applied and/or generated in the reaction. The upper strip 16 is shown in its shrunk configuration in solid in FIG. 5. For example, the width of the strip as shown in FIG. 5 and as measured widthwise along its surface and from staple 26 to staple 26, may be of the order of 10-15% less than before activation, as shown in FIG. 4. It also should be noted that although the surface-measured width of the top strip 16 has been reduced, the height of the hardened shank is greater than the original height of the unactivated shank strip. By way of example, with an uncured shank strip as shown in FIG. 4, the height of the strip initially may be of the order of 0.090 inches in thickness (height) whereas after having been cured, the height of the hardened strip, shown in FIG. 5, may be of the order of 0.135 inches in height, an increase of approximately 50% in height. It also should be noted that the cross section of the hardened shank is generally convex (along its upper surface) as compared to the approximately rectangular configuration of the matrix before curing. This is believed to result from early deterioration or melting of the lower strip 18 which permits the resinous matrix to flow freely within the region defined between the insole and the top strip. The resin tends to fill out this volume which results in the generally convex shape of the hardened shank and in which the lateral edges of the shank taper and gradually slope toward the surface of the insole bottom. As the bottom strip 18 deteriorates, the top strip 16 no longer is constrained to an approximately rectangular configuration and can assume the more convex shape shown in FIG. 5 under the influence of resin flow. Moreover, as the upper strip 16 shrinks, that tends to apply a light pressure to the resin to cause it to flow somewhat laterally outwardly which promote forming of the gradually tapering side edges.

As mentioned above, the principles of the invention may be employed with an upper strip 16 which will have little or no tendency to shrink yet which will still retain its dimensional characteristics at least until the resin has cured to a substantially final shape. This is suggested somewhat diagrammatically in FIG. 5 in which the phantom line 17 represents the comparative configuration of the cured shank when a non-shrinkable upper strip 16 is employed. As can be seen, the height of the shank will be greater than that which results when the shrinkable top strip 16 is employed and, for example, may be of the order of 0.150 inches in height. Whether a shrinkable or a non-shrinkable top strip is employed, it is important that the material from which the top strip is formed be selected from one which will not deteriorate during curing to an extent which would permit expansion of the resin beyond predetermined limits. By way of example, in the absence of confinement of the resin as described herein, there have been instances in which the height of the finally formed shank increased about three-fold (e.g. from 0.09 inches initial height to approximately 0.30 inches height). Such a magnitude of increased height is undesirable because it usually is accompanied by formation of relatively large gas bubbles which might effect the strength of the shank and also because a shank of that height often will interfere with subsequent shoe making procedures, such as attachment of the outsole, as will be appreciated by those of skill in the shoe art.

FIG. 6 illustrates a shank strip having a substantially flat lower strip 18 and a channel-shaped upper strip 16. The resulting product is substantially the same as that illustrated in FIG. 5.

I have found that in most instances, it is desirable to utilize a top strip 16 which will shrink during reaction of the matrix, for example, in response to elevated temperatures from the exothermic reaction or from the combination of exothermal and applied heat. Use of a shrinkable top strip thus provides control over the height and cross section of the region confined by the top strip. In addition to controlling the height and cross-sectional shape of the resulting stiffener, the use of an upper strip which will shrink during the activation or curing procedure also applies a light compressive force to the resin which minimizes any tendency for large bubbles to form within the resinous matrix, which might reduce the strength of the stiffener. Still another advantage which results from using a top strip which will shrink, is that the resulting stiffener is relatively smooth and is free of significant bumps, wrinkles, ripples or other irregularities which might be undesirable. The shrinkable top strip material may be either axially or biaxially oriented and a number of such materials are available. I have found that a Mylar polyester film which is biaxially oriented provides good results.

In a specific example of forming a hardened completed shank strip in accordance with this invention, upper strip 16 is 0.0005 inch thick Mylar type M24 with a heat shrink of 20% and lower strip 18 is 0.001% inch thick low density polyethylene. The matrix is a polyester syrup formed of maleic acid and a polyol sold by Reichold Chemical Co., of White Plains, New York under Number 31.402 and containing 40% by weight of diallyl phthalate monomers. The viscosity of the syrup is 4000-6000 centipoise (Brookfield −77° F.), one hundred grams of this syrup is mixed with 20 grams of diallyl phthalate monomer to bring the syrup to 50% total weight of diallyl phthalate 2% by weight of the syrup of t-butyl perbenzoate is incorporated as a catalyst. The saturated glass rovings are formed in sixteen parallel bundles having a weight of 0.0015 to 0.0018 pounds per linear inch of rope. The rope formed is as in FIG. 1 with each margin having a width of 3/8" and the matrix contained in a center sleeve having a width of 9/16" for a total side to side dimension of 15/16" and a matrix thickness of about 0.09 inch. The rope is cut to form a 4 inch long shank strip which is stapled to a shoe as shown in FIG. 2. The shank is then exposed to an infrared line heater in the form of a six inch long lamp positioned to give a 9/16" wide beam. After 6 to 8 seconds of exposure the shank is hardened in its final form after first reaching a top surface temperature of 320° F. to 420° F. The resulting shank is adhered to the shoe bottom and its matrix has been re-shaped and has expanded slightly over its original thickness.

The matrix resin materials preferably have storage viscosities before forming of from 150 centipoises to 1350 poise (Brookfield viscometer at 77° F., RVF Spindle #7). Preferably, the resins can be hardened to thermoset materials having hardness values sufficient to act as excellent shoe shanks as for example values of from 40 to 80 Barcol. Thermosetting materials such as cross linking polyesters, epoxies, phenolics, silicone, urethanes and polyvinyls can be used with conventional fillers, pigments and catalysts. The resin materials have long storage lives of three months or more at standard room temperature.

The reinforcing fibers of the matrix are preferably glass fibers having diameters of from 0.001 to 0.015 inch formed in roving bundles with from twelve to sixteen bundles about a center axis. Other reinforcement fibers such as metal, polyester, carbon and the like can be used. Preferably, the fibers are used in amounts of from 20 to 75% of the total rope weight and are completely embedded in the thermosetting material.

The thermosetting matrix material can be activatable by an appropriate external stimulus. Preferably, radiant energy is used in the form of infrared energy as from a tungsten-quartz lamp with a wavelength of from 4000 to 40000 angstroms. The matrix can be cured or thermoset to hardened form by other means as for example R.F. energy, electric or other heaters, ultraviolet and the like depending on the particular matrix used.

From the foregoing, it will be appreciated that the improved sleeve construction provides a number of advantages, particularly with respect to control over the height and cross-sectional shape of the stiffener as well as with respect to the handling of the shank strip. These advantages are achieved by utilizing an upper strip which is formed from a material which will not deteriorate (i.e. will maintain its strength, mechanical properties and physical characteristics) at least to the extent necessary to control the shape of the shank at least until the shank strip has set to its final shape. It should be understood, however, that the foregoing description of the invention is intended merely to be illustrative and that other embodiments and modifications may be apparent to those skilled in the art without departing from its spirit.

Having thus described the invention, what I desire to claim and secure by Letters Patent is:

1. A method for stiffening the shank region of a shoe insole comprising:

applying a shank strip to a shoe insole, said shank strip including a flexible, moldable matrix of thermosetting resin activatable by a selected external stimulus, said resin being covered with a sheet of material of a character which will transmit said selected external activating stimulus to the resin;

mechanically securing only selected marginal portions of the covering sheet against the surface of the shoe insole to confine the resin between the strip and the shoe insole;

and exposing the shank strip to a selected external activating stimulus while maintaining said confinement of the shank strip to the shape and volume defined by the covering sheet to thereby control the shape of the resultant stiffened shank strip.

2. A method as defined in claim 1 wherein said covering sheet is formed from a material which will resist deterioration in response to said selected external stimulus during setting of the resin, at least until the resin has cured to a substantially permanent shape.

3. A method in accordance with claim 1 wherein said covering sheet is formed from a material which will at least retain tensile strength during activation and curing of the resin and at least until the resin is no longer moldable.

4. A method as defined in claim 1 wherein said selected external stimulus comprises heat and wherein said sheet with which the resin is covered is shrinkable in response to heat;

and said stimulus being heat which causes the covering sheet material to be heated to effect shrinkage thereof to control the cross sectional shape of the resultant stiffened shank strip.

5. A method for stiffening the shank region of a shoe insole as defined in claim 21 wherein the external stimulus comprises heat, said method further comprising:

applying a resin matrix and covering sheet to the insole in the form of a sleeve having a bottom thermoplastic strip in which the longitudinal margins of the covering strip and lower thermoplastic strip are joined to each other, said bottom thermoplastic strip being formed from a material which melts under the influence of heat applied to the sheet.

6. A method for stiffening the shank region of a shoe insole as defined in claim 21 further comprising:

said step of applying said shank strip to the insole comprising applying said strip in a substantially flat form of approximately rectangular cross section; and during activation of the resin, but at least before it has cured to a substantially final shape, shrinking the covering sheet to mold the still-moldable resin to a shape in which its upper surface will be convex.

* * * * *

UNITED STATES PATENT AND TRADEMARK OFFICE

CERTIFICATE OF CORRECTION

PATENT NO. : 4,258,449

DATED : March 31, 1981

INVENTOR(S) : Robert W. Bradley

It is certified that error appears in the above—identified patent and that said Letters Patent is hereby corrected as shown below:

Column 3, line 9 "4" should --14--;

Column 3, line 38 "3/4" should be --3/4"--

Column 3, line 39 "3/4"" should be --3/8"--

Column 10, line 2, claim 6 "21" should be --1--

Column 9, line 17, claim 5 "21" should be --1--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*